United States Patent [19]

Ikegami et al.

[11] Patent Number: 4,497,674

[45] Date of Patent: Feb. 5, 1985

[54] METHOD AND APPARATUS FOR CONTINUOUSLY ANNEALING STEEL SHEET

[75] Inventors: Hiroshi Ikegami; Kozaburo Ichida; Katsuyoshi Kobayashi, all of Kitakyushu, Japan

[73] Assignee: Nippon Steel Corporation, Tokyo, Japan

[21] Appl. No.: 615,528

[22] Filed: May 31, 1984

[30] Foreign Application Priority Data

May 31, 1983 [JP] Japan ..... 58-95017
Jan. 5, 1984 [JP] Japan ..... 59-80

[51] Int. Cl.[3] ..... C21D 9/56

[52] U.S. Cl. ..... 148/156; 266/102; 266/103; 226/189; 34/156

[58] Field of Search ..... 266/102, 103, 111–113; 148/156, 153, 155; 432/8, 59; 226/189; 34/156

[56] References Cited

U.S. PATENT DOCUMENTS 3,325,620 6/1967 Hunt et al. ..... 266/103

FOREIGN PATENT DOCUMENTS 80641 6/1980 Japan .
100635 6/1983 Japan .

*Primary Examiner*—L. Dewayne Rutledge
*Assistant Examiner*—Christopher W. Brody
*Attorney, Agent, or Firm*—Wenderoth, Lind & Ponack

[57] ABSTRACT

Steel strip is continuously annealed while successively travelling through a heating, soaking, primary cooling, overaging and secondary cooling zone in an annealing furnace. In the overaging zone, an endless steel strip is allowed to run through a passageway that extends spirally from the entry end of the overaging zone to the point where overaging is completed, at a given distance in the direction of radius. The guide strip travels at the same speed as the steel strip being processed that is delivered from the primary cooling zone. On the entry side of the overaging zone, the strip being processed is laid over the guide strip so that the two strips spirally travel through the overaging zone side by side. The processed and guide strips running together are shifted out of the spiral passageway at the point where overaging is completed. Then, the processed strip is separated from the guide strip by shifting at least one of the two strips. While the separated processed strip is delivered to the subsequent secondary cooling zone, the guide strip is returned to the entry end of the overaging zone for the next trip through the spiral passageway. Helical devices are used for changing the position and running direction of the strip being processed and the guide strip. The overaging furnace is annular in shape, provided with a number of radially disposed guide rolls on the inside. Each guide roll has a plurality of guide grooves in which both edges of the guide strip are fitted.

15 Claims, 17 Drawing Figures

METHOD AND APPARATUS FOR CONTINUOUSLY ANNEALING STEEL SHEET

BACKGROUND OF THE INVENTION

This invention relates to a method and apparatus for continuously annealing steel sheet, and more particularly to a method and compact apparatus for continuously annealing steel sheet that permits implementing overaging over a long period of time.

In continuous annealing of steel sheet in strip form (hereinafter called steel strip), as is wellknown, steel strip as cold-rolled is heated to a temperature of approximately 700° to 850° C., soaked for approximately 1 minute for recrystallization, and then cooled rapidly to approximately 400° C. to allow the carbon in the steel to become supersaturated. Then, the steel is subjected to overaging for 2 to 3 minutes in a furnace maintained at approximately 400° C. to cause the solute carbon to precipitate that is detrimental to the workability of the product strip.

Conventional annealing with this heat cycle is adequate for the manufacture of steel strip of ordinary working quality, but not for deep-drawing quality steel that is required to have a particularly high degree of workability. This is because the overaging of 2 to 3 minutes is not enough to cause the solute carbon to precipitate adequately. The result is a lowering in workability that appears as a rise in yield point, a decrease in elongation and the development of yield point elongation through the process of aging deterioration after manufacturing. A solution to this problem has been to reduce carbon content to a minimum in the steelmaking process, with a minute amount of residual carbon fixed as a compound by adding titanium or other appropriate element. The high-workability steel thus produced is inevitably costly though it eliminates the need for overaging treatment. Attaining high workability with ordinary inexpensive steel (containing 0.03 to 0.05 percent carbon) calls for overaging treatment of long duration, which has simply been impracticable with the conventional vertical annealing furnace equipped with a large-diameter hearth roll because the equipment size would become tremendously large.

Generally aging deterioration is evaluated in terms of aging index. It is said that steel is suited for deep drawing if its aging index is approximately 3 kg/mm$^2$ or under. To attain an aging index of not higher than 3 kg/mm$^2$ with the inexpensive steel just mentioned, the steel must be overaged for a period of 20 to 30 minutes. This overaging time is more than 10 times longer than that in the conventional annealing heat cycle. In order to carry out this long overaging on a conventional vertical furnace, the overaging section alone must have a length of 300 m to 500 m, which is simply impracticable.

Japanese Patent Public Disclosure No. 100635 of 1983 discloses a continuous annealing apparatus that permits implementing overaging with a compact furnace. As shown in FIG. 1, this apparatus is designed to hold a large quantity of steel strip 1 in a limited space by winding the strip into a loosely coiled form. In order to keep the outside and inside diameters of a loose coil 3 from changing as the strip 1 travels forward, both the outside and inside of the loose coil 3 are forcibly restrained by guide rolls 5 and 6. Since the peripheral speed of the strip is kept constant on this type of apparatus, however, the angular speed of the strip 1 with respect to the center of the coil 3 increases toward the inside. Therefore, slip between wraps of the strip 1 is unavoidable. When the number of wraps increases, in addition, the cumulative frictional force between the individual wraps grows too large for the guide rolls 5 and 6 to maintain the outside and inside diameters of the coil within the desired limits.

With a conventional vertical continuous annealing furnace using hearth rolls, strip is bent to the radius of curvature of a hearth roll when the strip is turned into a different direction, whereupon stress-aging is likely to occur. Therefore, it has been necessary to use hearth rolls with a considerably large diameter, such as one meter or more, or make some other provisions to inhibit or avoid such stress-aging.

SUMMARY OF THE INVENTION

This invention has been made to provide a solution to the aforementioned problems with the conventional technique. An object of this invention is to provide a continuous annealing method and apparatus that permit implementing overaging of long duration using a compact furnace.

Another object of this invention is to provide a continuous annealing method and apparatus in which wraps of steel strip being processed are kept out of contact with each other to cause neither slip nor friction when travelling through an overaging zone in spiralled form.

According to this invention, steel strip is continuously annealed while successively passing through the heating zone, soaking zone, primary cooling zone, overaging zone and secondary cooling zone in an annealing furnace. The strip passes through the overaging zone along passageway extending spirally from the entry end to the exit end, with a guide strip that runs at a given distance in the direction of radius. The guide strip runs at the same speed as the strip leaving the primary cooling zone. Lapped over at the entry end, the guide strip and the strip being processed spirally travel side by side through the overaging zone. At the point where overaging is completed, the two strips are shifted out of the spiral passageway. Then, at least one of the two strips is shifted again to separate the processed strip from the guide strip. The strip processed is then delivered into the subsequent secondary cooling zone. The guide strip, on the other hand, is returned to the entry end of the overaging zone for another cycle of travel through the spiral passageway.

The two strips may be allowed to travel together spirally either in a horizontal plane or in a vertical plane. Also, the strip being processed may be guided either from the outside to the inside of the spiral passageway or, conversely, from the inside to the outside.

The method described above can be effectively achieved on a continuous annealing apparatus comprising a heating furnace, soaking furnace, primary cooling furnace, overaging furnace and secondary cooling furnace. The overaging furnace has an annular furnace chamber and a communication passage to connect the internal boundary of the annular chamber with the external boundary thereof. In the annular furnace chamber are radially and rotatably provided a number of guide rolls in such a manner as to cross the annular chamber, spaced away from each other in the direction of the ring axis. Each guide roll has a plurality of guide grooves that are axially spaced from each other. The guide rolls are rotated by an electric motor or other suitable means. At the entry end of the annular furnace chamber that is on the external side thereof, there are provided devices to shift the running direction of the processed and guide strips. At the exit end of the annular furnace chamber are provided a device to shift the running direction of the processed and guide strips and a device to separate the processed strip from the guide strip. With both edges thereof held in the guide grooves, the endless guide strip circulates through the annular furnace chamber and communication passage as guided by the guide strip shifting device, processed and guide strips shifting device and processed and guide strips separating device.

In the apparatus just described, the strip being processed is laid over the guide strip on the entry side of the overaging zone so that the two strips spirally travel together through the annular furnace chamber. At the point where overaging is completed, the two strips are shifted outside the spiral passageway. Then, at least one of the two strips is shifted again to separate the processed strip away from the guide strip. While the processed strip moves on into the subsequent secondary cooling zone, the guide strip returns to the entry end of the overaging zone to repeat the travel through the spiral passageway.

The apparatus just described is constructed so that the strip being processed is guided from the outside of the spiral to the inside, but it is also possible to guide the strip in the opposite direction, i.e., from inside to outside.

According to this invention, overaging of long duration can be performed using a compact apparatus, without interrupting the travel of the strip being processed. The strip being processed travels spirally through the overaging zone together with the guide strip that is held by the guide grooves on the guide rolls. Since the guide grooves are provided at given intervals, wraps of the strip being processed are kept away from each other to avoid a slip or friction therebetween.

With the apparatus of this invention, the minimum radius of curvature of strip in the overaging zone is one-half the inside diameter of spiral passage way. Obviously, this value is much larger than the radius of curvature of large-diameter hearth rolls that have been used so far and, therefore, dispense with the need to make any stress-aging inhibiting or avoiding provisions.

As will be evident from the above, this invention offers an epoch-making new technology that permits manufacturing deep-drawing quality steel strip by continuously annealing steel of ordinary quality (not ultra-low carbon steel) which has conventionally been impossible.

DETAILED DESCRIPTION OF THE PREFERRED EMBODIMENTS

Figure 1:
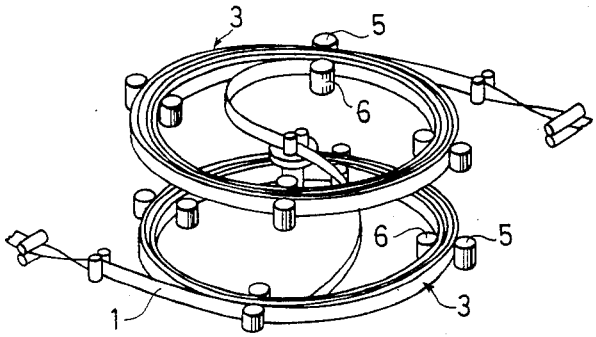
FIG. 1 is a perspective view showing a conventional apparatus in which strip being processed travels spirally.
Figure 2:
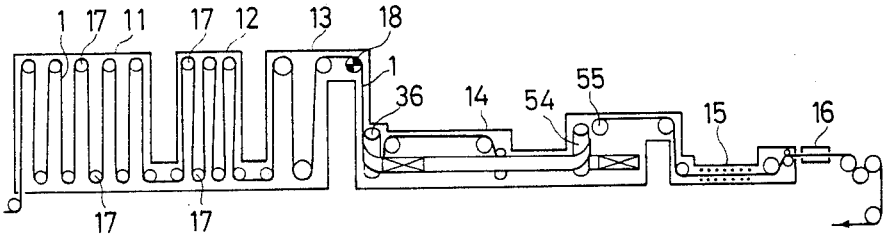
FIG. 2 is a schematic illustration of a continuous annealing apparatus embodying the principle of this invention.

FIG. 2 is an overall view of a continuous annealing apparatus according to this invention, which comprises a heating furnace 11, soaking furnace 12, primary cooling furnace 13, overaging furnace 14 and secondary cooling furnace 15. A number of hearth rolls 17 are provided near the top and bottom of the heating furnace 11, soaking furnace 12 and primary cooling furnace 13. Steel strip being annealed 1 is passed over the hearth rolls 17. Between the primary cooling furnace 13 and the secondary cooling furnace 14 is provided the annular overaging furnace 14 in such a manner that the axis of annular ring extends vertically.

Figure 3:
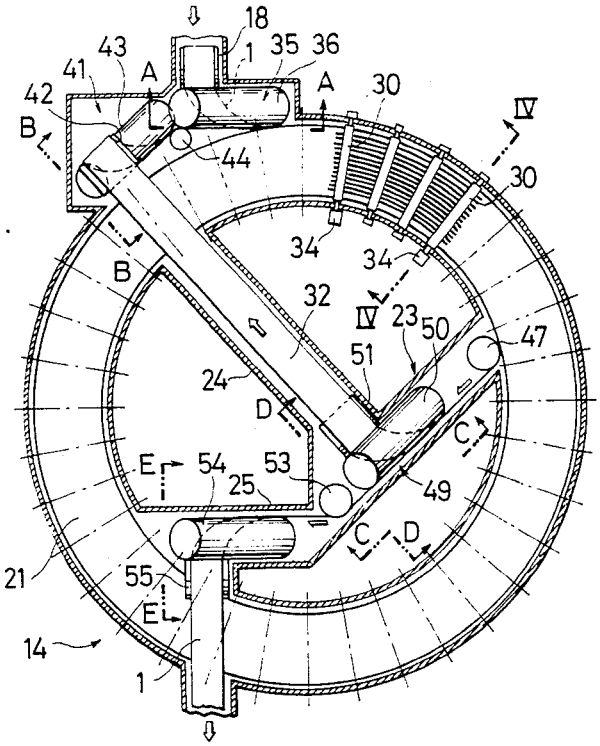
FIG. 3 is a cross-sectional plan view showing an example of a long-time overaging furnace provided in the apparatus shown in FIG. 2.
Figure 4:
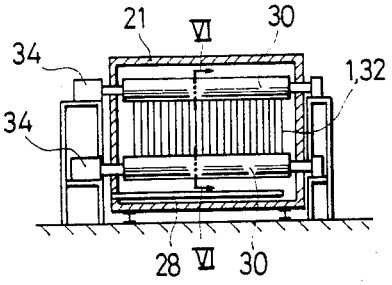
FIG. 4 is a cross-sectional view taken along the line IV—IV of FIG. 3.

FIGS. 3 and 4 show details of the overaging furnace 14. As may be seen, the furnace chamber 21 of the overaging furnace is rectangular in cross section and annular in entirety. One point of the external side of this annular furnace chamber 21 communicates with the exit end of the primary cooling furnace 13. As shown in FIG. 4, a heater 28, such as an electric heater, is provided at the bottom of the annular furnace chamber 21 in order to maintain the desired furnace temperature.

The external side and internal side of the annular furnace chamber 21 is connected by a communication passage 23. Dhe communication passage 23 branches midway into a return passage 24 and an outgoing passage 25. The exit end of the return passage 24 is connected to the entry end of the annular furnace chamber 21 and the exit end of the outgoing passage 25 to the entry end of the secondary cooling furnace 15.

Figure 5:
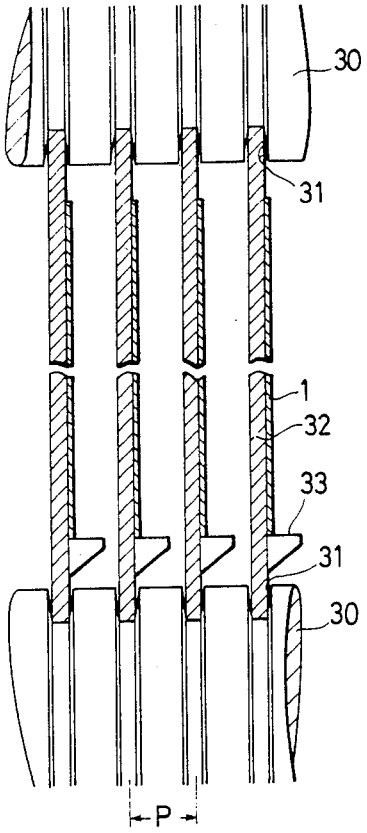
FIG. 5 is a detailed cross-sectional view of a spiral passageway.

In the annular furnace chamber 21, there are provided a number of radially extending, rotatable guide rolls in such a manner as to cross the chamber 21. The guide rolls 30 are paired vertically or in the direction of the axis of the annular chamber 21. A plurality of guide grooves 31, spaced away from each other along the roll axis, are provided on each guide roll, as shown in FIG. 5.

Figure 6:
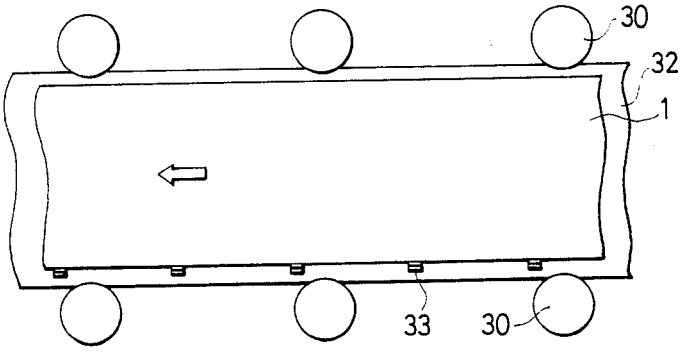
FIG. 6 is a cross-sectional view taken along the line VI—VI of FIG. 4.

The edge of a guide strip 32 fits in the guide groove 31. Guided by the guide rolls 30, the guide strip 32 travels in the longitudinal direction, with the width thereof extending vertically as shown in FIG. 6. After each round trip through the annular furnace chamber 21, the guide strip 32 moves from one guide groove 31 to the next guide groove 31 on the inside. This causes the guide strip 32 to travel spirally or helically through the annular furnace chamber 21. The guide strip 32 is endless so as to travel around the annular furnace chamber 21 and communication passage 23. Close to the lower edge of the guide strip 32 are welded regularly spaced pawls 33 to support the edge of the strip being processed 1, as shown in FIG. 5.

The pitch P between the guide grooves 31 provides a smallest possible space (e.g., 20 mm) in which the strip being processed 1 is kept out of contact with the guide strip 32. Instead of being paired vertically, the guide rolls 30 may be disposed in a staggered arrangement. The guide rolls 30 are rotated by a motor 34.

A device to shift the running direction of the strip being processed 35 and a device to shift the running direction of the guide strip 41 are provided on the entry side of the annular furnace chamber 21.

Figure 7:
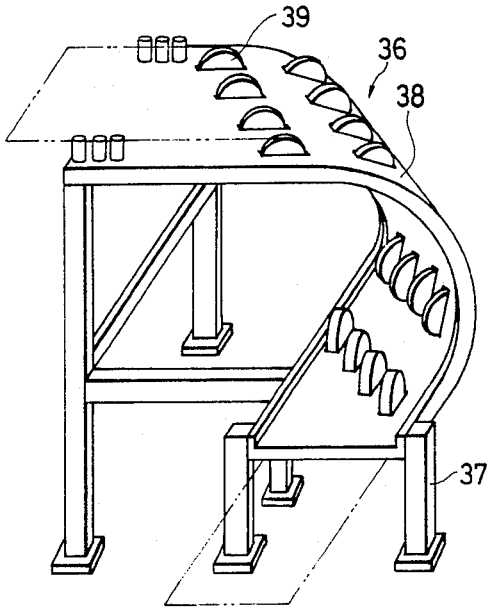
FIG. 7 is a perspective view of a roller-type helical turn device.
Figure 8:
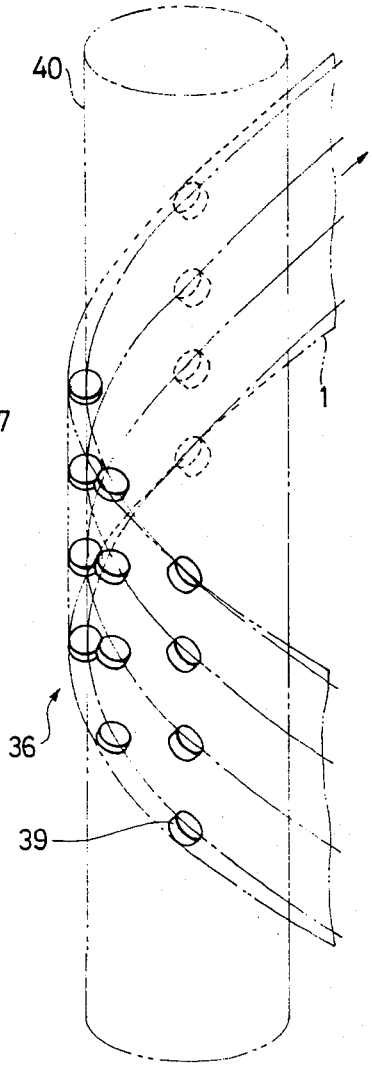
FIG. 8 illustrates the manner in which the rollers of the helical turn device of FIG. 7 are arranged.
Figure 9A:
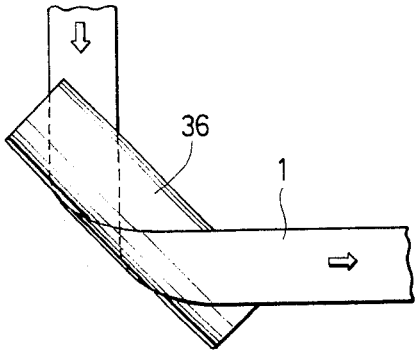
FIGS. 9(A), (B), (C), (D) and (E) illustrate the manner in which the running direction of a strip being processed and a guide strip is changed, being cross-sectional views taken along the lines A—A, B—B, C—C, D—D and E—E of FIG. 3, respectively.

The processed strip shifting device 35 consists of a first processed strip helical turn device 36. The "metal strip running direction changing device" developed by the inventors and disclosed in Japanese Patent Public Disclosure No. 80641 of 1980 is used as the helical turn device 36. The first processed strip helical turn device 36 consists of a number of rotatable small rollers 39 mounted on a curved base plate 38 supported by a stand 37, as shown in FIG. 7. The base plate 38 is helically curved along a cylindrical surface 40 shown in FIG. 8, while a plurality of small rollers 39 are arranged breadthwise and longitudinally along the helical surface 40 so as to support the strip being processed 1. The first processed strip helical turn device 36 changes the position of the strip 1 descending from the hearth roll 18 at the exit end of the primary cooling furnace 13 so that the width of the strip extends vertically and changes the direction of strip travel from vertical to horizontal as shown in FIG. 9(A).

Figure 9B:
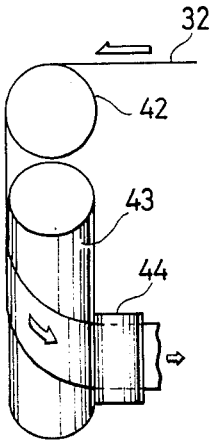

The guide strip running direction shifting device 41 consists of a first guide strip deflector roll 42, a first guide strip helical turn device 43, and a second guide strip deflector roll 44. The structure of the guide strip helical turn device 43 is the same as that of the first processed strip helical turn device 36 described before. The guide strip helical turn device 43 changes the position of the guide strip 32 descending from the first guide strip deflector roll 42 so that the width of the strip extends vertically and changes the direction of strip travel from vertical to horizontal as shown in FIG. 9(B). Guided by the second guide strip deflector roll 44, the guide strip 32 is laid over the strip being processed 1 at a point where the first processed strip helical turn device 36 is positioned.

A processed and guide strips deflector roll 47 is disposed on the exit side of the annular furnace chamber 21 in such a manner as to contact the internal surface of the annular furnace chamber 21. Changing the running direction of the processed and guide strips 1 and 32, the deflector roll 47 leads the two strips from the annular furnace chamber 21 to said communication passage 23.

Figure 9C:
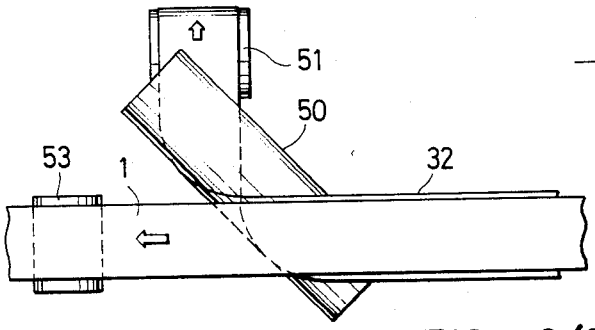

A processed and guide strips separating device 49 is provided where the communication passage 23 branches as described previously. The separating device 49 consists of a second guide strip helical turn device 50 that is identical to the first processing strip helical turn device 36. Here, only the guide strip 32 changes its running direction as shown in FIG. 9(C).

Figure 9D:
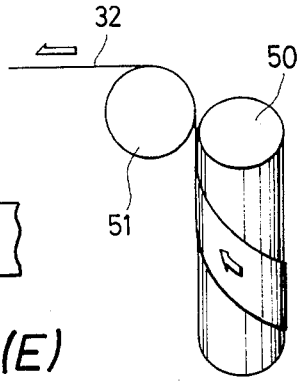

A third guide strip deflector roll 51 is provided on the entry side of the return passage 24 or on the exit side of the processed and guide strips separating device 49. As shown in FIG. 9(D), the third guide strip deflector roll 51 changes the running direction of the guide strip 32 from the processed and guide strips separating device 49. The guide strip 32 passes over the third guide strip deflector roll 51 and the first guide strip deflector roll 42 in such a manner as to stride over the strip being processed 1 and the guide strip 32 that spirally travel through the annular furnace chamber 21, as shown in FIG. 3.

Figure 9E:
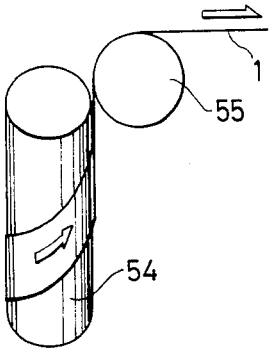

A first processed strip deflector roll 53 is provided on the entry side of the outgoing passage 25, with a second processed strip helical turn device 54 and a second processed strip deflector roll 55 provided on the exit side thereof. By changing the running direction, the second processed strip helical turn device 54 and the second processed strip deflector roll 55 deliver the processed strip 1, which is supplied via the first processed strip deflector roll 53 from the processed and guide strips separating device, to the secondary cooling furnace 15, as shown in FIG. 9(E).

Successively guided by the first guide strip deflector roll 42, first guide strip helical turn device 43, second guide strip deflector roll 44, processed and guide strips deflector roll 47, second guide strip helical turn device 50 and third guide strip deflector roll 51, the guide strip 32 circulates through the overaging furnace 14.

An overaging treatment that is performed using the continuous annealing apparatus of the above structure will be described in the following.

After passing through the heating furnace 11, soaking furnace 12 and primary cooling furnace 13, the strip being processed 1 enters the overaging furnace 14. By way of the secondary cooling furnace 15 (where water-spray cooling is provided in the embodiment shown in FIG. 2) and a drier 16, the strip is delivered to an exit-side looper.

In the continuous annealing apparatus shown in FIG. 2, the first processed strip helical turn device 36 changes the direction of the strip being processed 1, which has a temperature of approximately 400° C. after leaving the primary cooling furnace, on the entry side of the overaging furnace 14 so that the width thereof extends vertically.

The strip 1 thus turned is laid over the endlessly circulating guide strip 32 to spirally travel together through the overaging furnace from outside to inside.

The guide strip 32 is driven by a group of guide rolls 30 that are radially arranged with respect to the center of the spiral. The strip being processed 1 travels with the guide strip 32 on the external side thereof. For lack of rigidity, it is impossible to cause the strip 1 alone to travel spirally. When laid over the guide strip 32 having adequate rigidity, however, the strip 1 can travel in an upright position or with the width thereof extending vertically.

When the processed strip 1 and guide strip 32 reach the innermost zone in FIG. 3, the processed and guide strips deflector roll 47 guides the two strips therefrom to the processed and guide strips separating device 49, where the second guide strip helical turn device 50 sends the guide strip 32 upward by changing the position of the width thereof from vertical to horizontal. Detached from the guide strip 32, the processed strip 1 is delivered to the subsequent secondary cooling furnace 15 by way of the first processed strip deflector roll 53, second processed strip helical turn device 54 and second processed strip deflector roll 55.

Next, the guide strip 32 returns to the external side of the spiral via the third guide strip deflector roll 51 and further to the original position by way of the first guide strip deflector roll 42, first guide strip helical turn device 43 and second guide strip deflector roll 44.

The position of the pawl 33 to support the edge of the guide strip 32 is set to accommodate strip of the greatest width set forth by equipment specification. When strip of smaller width is processed, the edge thereof lies above the pawl 33 upon entering the overaging furnace 14 and gradually descends to the pawl 33 while travelling forward spirally. In order to make sure that the strip edge is always kept above the pawl 33 at the entrance of the overaging furnace 14, it is desirable to use a steering roll as the exit end hearth roll 16 of the secondary cooling furnace 13.

Figure 10:
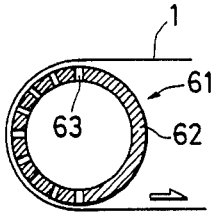
FIG. 10 illustrates a gas-floating type helical turn device.

For the helical turn device, a gas-floating type helical turn device 61 as shown in FIG. 10 may be used. This helical turn device 61 consists of a hollow cylinder 62 provided with many nozzles 63 in the wall thereof. As with the small rollers 38 on the rollertype helical turn device 36 described previously, the nozzles 63 are arranged across the width, along the cylindrical surface, and spirally. The pressurized gas ejected through the nozzles 63 causes the strip 1 to float. The gas is part of the atmosphere gas extracted from within the furnace, pressurized by a compressor (not shown) and supplied to the nozzles 63.

To prevent the imprinting of marks on the strip surface, the processed strip helical turn devices 36 and 54 at the entry and exit ends should preferably be of the gas-floating type, whereas the roller type is sufficient for the guide strip helical turn devices 43 and 50.

The following is a discussion of the capacity of the overaging furnace according to this invention.

Given that the overall length of the strip processed is L, the inside and outside diameters of the spiral passageway are $D_1$ and $D_2$, and the spiral pitch is P, $$L = \frac{\pi}{2}\left(\frac{D_1 - D_2}{2P} + 1\right)(D_1 + D_2)$$

If, for example, $D_1 = 15$ m, $D_2 = 20$ m and $P = 20$ mm, then $L = 6900$ m. Then overaging treatment of this strip can be completed in 30 minutes with a line speed of 230 m per minute.

As will be evident from FIG. 3, this invention permits performing overaging treatment of long duration in a compact furnace. Furthermore, no high building is needed to accommodate the overaging furnace and other subsequent facilities, allowing a significant saving in construction cost.

In the overaging furnace 14 of the above-described structure, the strip being processed 1 and the guide strip 32 may be allowed to run in opposite directions. In such a case, as will be obvious from FIG. 3, the strip being processed 1 is laid over the guide strip 32 by means of the second guide strip helical turn device 50 and the first processed strip deflector roll 53. The roller-type helical turn device 36 separates the processed strip 1 from the guide strip 32.

A second embodiment of this invention will be described in the following paragraphs.

The basic configuration of the second embodiment is similar to that of the first embodiment. The difference between the two embodiments is the position in which the annular furnace chamber is disposed in the overaging furnace. While the annular furnace chamber in the first embodiment is placed in the upright position, that in the second embodiment is in the horizontal position. As such, any parts similar to those in the first embodiment are designated by the same reference characters, with detailed description omitted.

Figure 11:
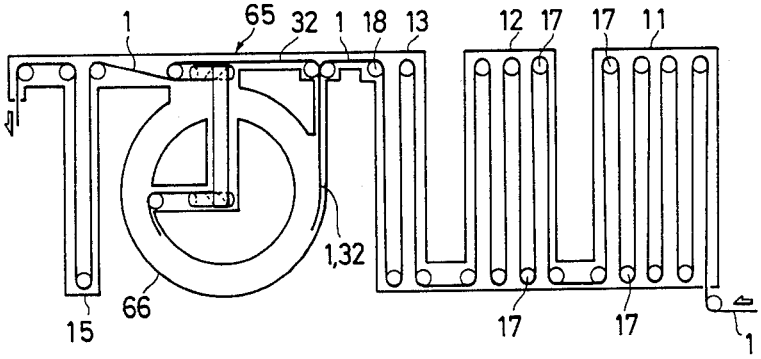
FIG. 11 is a schematic view of another embodiment of the continuous annealing apparatus according to this invention.

FIG. 11 is an overall view of the second embodiment. Like the first embodiment, this continuous annealing apparatus consists of a heating furnace 11, soaking furnace 12, primary cooling furnace 13, overaging furnace 65, and secondary cooling furnace 15. Between the primary cooling furnace 13 and secondary cooling furnace 15, there is provided the annular overaging furnace 65 in such a manner that the axis of the annular ring extends horizontally.

Figure 12:
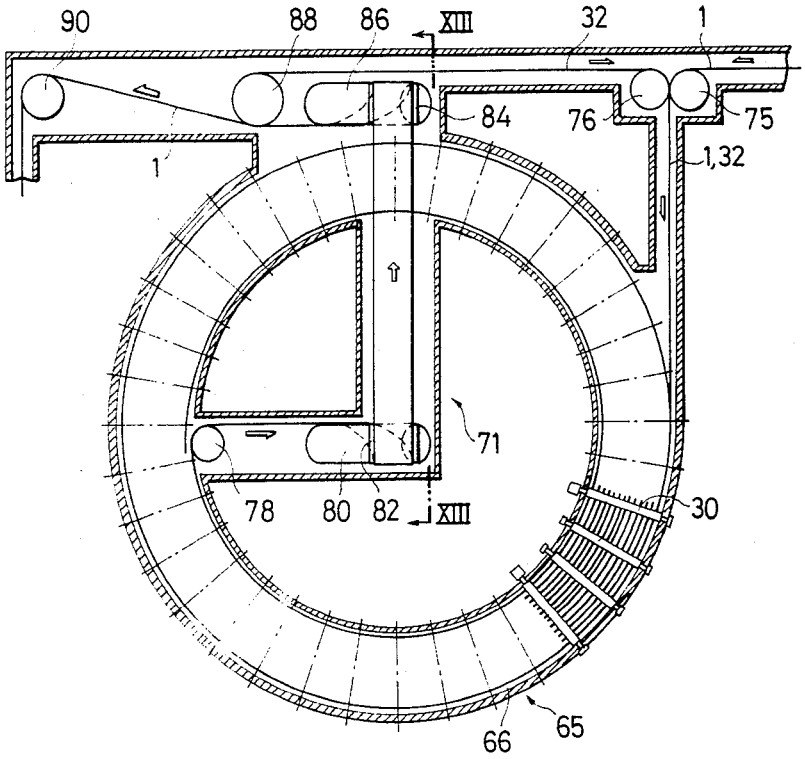
FIG. 12 is a vertical cross-section of a longtime overaging furnace provided in the apparatus of FIG. 12.
Figure 13:
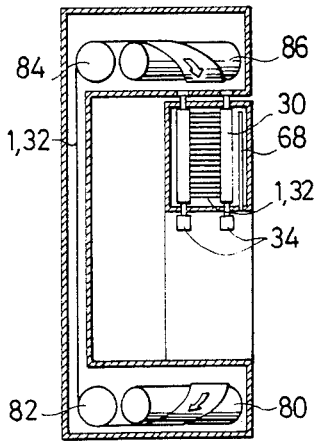
FIG. 13 is a cross-sectional view taken along the line XIII—XIII of FIG. 12.

FIGS. 12 and 13 show details of the overaging furnace 65. As shown in the figures, the furnace chamber 66 of the overaging furnace 65 is rectangular in cross section and annular as a whole. One point on the external side of the annular furnace chamber 66 communicates with the exit end of the primary cooling furnace 13. A heater 68 is provided on the wall of the annular furnace chamber 66 to keep the desired furnace temperature, as shown in FIG. 13.

The internal and external sides of the annular furnace chamber 66 are connected by a communicating passage 71. The communicating passage 71 extends inward from the internal side of the annular furnace chamber 66 and then turns perpendicularly near the center of the ring to extend outward.

A number of guide rolls 30 are provided in the annular furnace chamber 66. Each guide roll 30 is provided with axially spaced guide grooves. Guided by the guide rolls 30 in a vertical plane, the guide strip travels in the longitudinal direction thereof, as shown in FIG. 12.

A first processed strip deflector roll 75 and a first guide strip deflector roll 76 are oppositely disposed on the entry side of the annular furnace chamber 66.

The first processed strip deflector roll 75 changes the running direction of the strip being processed 1, which is delivered from the exit-end hearth roll 18 of the primary cooling furnace 13, from horizontal to vertical.

The first guide strip deflector roll 76 changes the running direction of the guide strip 32, which is delivered from a processed and guide strips separating roll 88 to be described later, from horizontal to vertical. Then, the guide strip 32 is laid over the strip being processed 1 between the first processed strip deflector roll 75 and the first guide strip deflector roll 76.

A first processed and guide strips deflector roll 78 is provided on the exit side of the annular furnace chamber 66 or adjacent to the internal side of the annular furnace chamber 66. The first processed and guide strips deflector roll 78 changes the running direction of the lapped strips 1 and 32 and deliver them from the annular furnace chamber 66 to said communicating passage 71

A first processed and guide strips helical turn device 80 and a second processed and guide strips deflector roll 82 are disposed where the communicating passage 71 bends as described previously. The first processed and guide strips helical turn device 80 is of the same structure as the first processed strip helical turn device 36 shown in FIG. 7. At this point, the strip being processed 1 and the guide strip 32 change the direction of travel as shown in FIGS. 12 and 13.

A third processed and guide strips deflector roll 84 and a second processed and guide strips helical turn device 86 are provided on the exit side of the communicating passage 71. At this point, the strip being processed 1 and the guide strip 32 change the direction of travel again as shown in FIGS. 12 and 13.

A processed and guide strips separating roll 88 is provided on the exit side of the second processed and guide strips helical turn device 86. The processed and guide strips separating roll 88 separates the processed strip 1 from the guide strip 32, sending the processed strip 1 forward while returning the guide strip 32 to said first guide strip deflector roll 76.

A second processed strip deflector roll 90 is disposed on the exit side of the annular furnace chamber 66. The second processed strip deflector roll 90 changes the direction of travel of the processed strip 1, which is sent from the processed and guide strips separating roll 88, and deliver to the secondary cooling furnace 15.

The guide strip 32 is successively guided by the first guide strip deflector roll 76, first processed and guide strips deflector roll 78, first processed and guide strips helical turn device 80, second processed and guide strips deflector roll 82, third processed and guide strips deflector roll 84, second processed and guide strips helical turn device 86 and processed and guide strips separating roll 88. After each round trip through the annular furnace chamber 66, the guide strip 32 moves from one guide groove to the next one on the inside. Accordingly, the guide strip 32 travels spirally through the annular furnace chamber 66.

The first embodiment required the pawls 33 on the guide strip 32 to support the edge of the strip being processed 1. In contrast, the second embodiment dispenses with the pawls 33 since the width of the processed and guide strips 1 and 32 is always kept horizontal, not vertical.

No discussion will be given to the overaging treatment performed in the continuous annealing apparatus just described since it is the same as that in the first embodiment described previously.

Compared with the first embodiment, the second embodiment requires fewer helical turn devices, which are complex in structure, and permits simplifying the structure of the communicating passage.

In the overaging furnace 14 thus constructed, the strip being processed 1 and the guide strip 32 may be allowed to run in opposite directions. In such a case, as is evident from FIG. 12, the strip 1 is laid over the guide strip 32 by the processed and guide strip separating roll 88. Then, the processed strip 1 is separated from the guide strip 32 by the first processed strip deflector roll 75 and the first guide strip deflector roll 76.

What is claimed is:

1. In a method of continuously annealing steel strip successively passed through a heating zone, soaking zone, primary cooling zone, overaging zone and secondary cooling zone in an annealing furnace, the overaging treatment comprises the steps of:

allowing an endless guide strip to run at the same speed as a strip being processed delivered from the primary cooling zone along a passageway spirally extending in the overaging zone and at a given distance in the direction of radius;

laying the strip being processed over the guide strip on the entry side of the overaging zone to allow the two strips to travel together spirally through the overaging zone;

guiding the processed and guide strips together out of the spiral passageway by changing the direction of the travel thereof at a point where the overaging treatment is completed;

separating the processed strip from the guide strip by changing the direction of the travel of at least one of the two strips;

delivering the separated processed strip to the subsequent secondary cooling zone; and returning the guide strip to the entry end of the overaging zone for the next circular trip through the spiral passageway.

2. In a continuous steel strip annealing apparatus comprising a heating furnace, soaking furnace, primary cooling furnace, overaging furnace and secondary cooling furnace, the overaging furnace comprises:

an annular furnace chamber the entry and exit ends thereof communicating on the external side thereof with the primary and secondary cooling furnaces, respectively, strip being processed entering the annular furnace chamber from the entry end thereof on the external side, travelling spirally therethrough and leaving from the exit end thereof on the internal side;

a communicating passage crossing the cylindrical space on the internal side of the annular furnace chamber to connect the internal and external sides of the annular furnace chamber, the strip being processed running through the communicating passage from the internal side of the annular furnace chamber to the external side thereof;

a number of guide rolls radially and rotatably provided in the annular furnace chamber in such a manner as to be spaced in the direction of the axis of the annular ring and radially cross the space within the annular furnace chamber, each guide roll being provided with a plurality of axially spaced guide grooves along the periphery thereof;

means rotating the guide rolls;

an endless guide strip adapted to move from one guide groove by which both edges of the strip is held to the next groove on the inside after each round trip through the annular furnace chamber, the guide strip spirally travelling through the annular chamber furnace along with the strip being processed that is laid over;

means shifting the running direction of the strip being processed on the entry side of the annular furnace chamber;

means shifting the running direction of the guide strip in such a manner as to be laid over the strip being processed, the shifting means being provided next to said means shifting the running direction of the strip being processed;

means shifting the processed and guide strips laid over out of the annular furnace chamber, the shifting means being provided on the exit side of the annular furnace chamber; and means shifting the running direction of the processed and guide strips and separating the processed strip from the guide strip on the downstream side of said processed and guide strips running direction shifting means;

the guide strip guided by the guide strip running direction shifting means, processed and guide strips running direction shifting means and processed and guide strips separating means circulating through the annular furnace chamber and communicating passage.

3. An apparatus according to claim 2, in which the annular furnace chamber is disposed with the axis thereof standing vertical.

4. An apparatus according to claim 2, in which the annular furnace chamber is disposed with the axis thereof extending horizontal.

5. An apparatus according to claim 3, in which the processed strip running direction shifting means, guide strip running direction shifting means and processed and guide strips separating means consist of a helical turn device which comprises a helically curved base plate and a number of strip supporting rollers that are rotatably provided over a width corresponding to the width of the strip on the helically curved base plate.

6. An apparatus according to claim 3, in which the processed strip running direction shifting means, guide strip running direction shifting means, and processed and guide strips separating means consist of a helical turn device which comprises a number of pressurized gas ejecting nozzles provided over a width corresponding to the width of the strip on the helical surface of a cylindrical member.

7. An apparatus according to claim 3, in which the guide strip having pawls to support the lower edge of the processed strip near the lower edge thereof.

8. An apparatus according to claim 4, in which the processed strip running direction shifting means and guide strip running direction shifting means consist of a deflector roll changing the running direction of the processed and guide strips from horizontal to vertical.

9. In a continuous steel strip annealing apparatus comprising a heating furnace, soaking furnace, primary cooling furnace, overaging furnace and secondary cooling furnace, the overaging furnace comprises:

an annular furnace chamber the entry and exit ends thereof communicating on the external side thereof with the primary and secondary cooling furnaces, respectively, strip being processed entering the annular furnace chamber from the entry end thereof on the internal side, travelling spirally therethrough and leaving from the exit end thereof on the external side;

a communicating passage crossing the cylindrical space on the internal side of the annular furnace chamber to connect the external and internal sides of the annular furnace chamber, the strip being processed running through the communicating passage from the external side of the annular furnace chamber to the internal side thereof;

a number of guide rolls radially and rotatably provided in the annular furnace chamber in such a manner as to be spaced in the direction of the axis of the annular ring and radially cross the space within the annular furnace chamber, each guide roll being provided with a plurality of axially spaced guide grooves along the periphery thereof;

means rotating the guide rolls;

an endless guide strip adapted to move from one guide groove by which both edges of the strip is held to the next groove on the inside after each round trip through the annular furnace chamber, the guide strip spirally travelling through the annular chamber furnace along with the strip being processed that is laid over;

means shifting the running direction of the strip being processed on the entry side of the annular furnace chamber;

means shifting the running direction of the guide strip in such a manner as to be laid over the strip being processed, the shifting means being provided next to said means shifting the running direction of the strip being processed;

means shifting the processed and guide strips laid over out of the annular furnace chamber, the shifting means being provided on the entry side of the annular furnace chamber; and means separating the processed strip from the guide strip, the separating means being provided on the exit side of the annular furnace chamber on the external side thereof;

the guide strip guided by the guide strip running direction shifting means, processed and guide strips running direction shifting means and processed and guide strips separating means circulating through the annular furnace chamber and communicating passage.

10. An apparatus according to claim 9, in which the annular furnace chamber is disposed with the axis thereof standing vertical.

11. An apparatus according to claim 9, in which the annular furnace chamber is disposed with the axis thereof extending horizontal.

12. An apparatus according to claim 10, in which the processed strip running direction shifting means, guide strip running direction shifting means and processed and guide strips separating means consist of a helical turn device which comprises a helically curved base plate and a number of strip supporting rollers that are rotatably provided over a width corresponding to the width of the strip on the helically curved base plate.

13. An apparatus according to claim 10, in which the processed strip running direction shifting means, guide strip running direction shifting means, and processed and guide strips separating means consist of a helical turn device which comprises a number of pressurized gas ejecting nozzles provided over a width corresponding to the width of the strip on the helical surface of a cylindrical member.

14. An apparatus according to claim 10, in which the guide strip having pawls to support the lower edge of the processed strip near the lower edge thereof.

15. An apparatus according to claim 11, in which the processed strip running direction shifting means, guide strip running direction shifting means and processed and guide strips separating means consists of a deflector roll.

* * * * *